United States Patent [19]

Crain et al.

[11] Patent Number: 4,504,242

[45] Date of Patent: Mar. 12, 1985

[54] MODULAR UNIT WITH TOY VEHICLE PROPULSION DEVICE

[75] Inventors: Philip W. Crain, San Pedro; Raymond M. St. Pierre, Hawthorne, both of Calif.

[73] Assignee: Mattel, Inc., Hawthorne, Calif.

[21] Appl. No.: 384,833

[22] Filed: Jun. 4, 1982

[51] Int. Cl.[3] ..... A63H 29/00

[52] U.S. Cl. ..... 446/429; 446/435

[58] Field of Search ..... 46/1 K, 202, 201, 206, 46/216; 273/86 D, 87.2, 87.4, 129 W, 89; 124/16

[56] References Cited

U.S. PATENT DOCUMENTS

| | | | |
|---|---|---|---|
| 1,368,875 | 2/1921 | Adams | 273/129 W |
| 2,106,625 | 1/1938 | Bodge | 273/129 W |
| 2,793,037 | 5/1957 | Smith | 273/129 W |
| 2,819,082 | 1/1958 | Peters | 273/129 W |
| 3,091,465 | 5/1963 | Ogdon | 273/129 W |
| 3,599,365 | 8/1971 | Carver | 46/1 K |
| 3,622,158 | 11/1971 | Tepper | 273/860 |
| 3,777,391 | 12/1973 | Barcus et al. | 46/1 K |
| 3,998,460 | 12/1976 | Dyer | 46/202 |
| 4,078,800 | 3/1978 | Goldfarb et al. | 273/89 |
| 4,146,991 | 4/1979 | Sano | 46/1 K |
| 4,203,603 | 5/1980 | Konta | 273/129 W |
| 4,248,426 | 2/1981 | Sims et al. | 273/129 W |
| 4,266,769 | 5/1981 | Saitoh | 46/1 K |
| 4,330,127 | 5/1982 | Brand et al. | 46/1 K |
| 4,345,402 | 8/1982 | Hanson et al. | 46/1 K |
| 4,356,657 | 11/1982 | Goldfarb et al. | 46/202 |

*Primary Examiner*—Robert A. Hafer
*Assistant Examiner*—Daniel Nolan
*Attorney, Agent, or Firm*—John G. Mesaros; Ronald M. Goldman; James G. O'Neill

[57] ABSTRACT

The object of the invention is to provide a modular unit for a toy vehicle traversing layout, the unit representing a city section and having a simulated street sign serving as a handle for carrying, the unit being further provided with a vehicle propulsion device for propelling toy vehicles along a simulated street. The modular unit is provided with the propulsion device adjacent a lane of the street with a plunger, upon depression rotating a pivotable drive member into engagement with the rear of a toy vehicle for propelling the same. The unit has a base with grooves in the undersurface thereof for receiving C-shaped connectors for interlocking a plurality of modular units together.

7 Claims, 6 Drawing Figures

MODULAR UNIT WITH TOY VEHICLE PROPULSION DEVICE

DESCRIPTION

1. Technical Field

The present invention relates to a modular unit for a toy layout, and particularly to a modular unit which simulates a city thoroughfare and which includes a toy vehicle propulsion device.

2. Background Art

The prior art, U.S. Pat. No. 3,624,956 provided for a bridge connector for connecting modular units together in a toy layout simulating thoroughfares.

Additionally, U.S. Pat. No. 3,622,158 discloses a vehicle propelling device for propelling a vehicle around a track forming a closed loop, with force being applied to the vehicle during movement along a propulsion region. A vehicle-driving member is located beneath, and moves along, the propulsion region in response to movement of a handle operated by a player.

CROSS-REFERENCE TO RELATED APPLICATION

This application is related to a patent application filed concurrently herewith entitled "Module for Simulated City Thoroughfare" by Philip Warren Crain, such application being assigned to the assignee of the instant invention.

DISCLOSURE OF INVENTION

According to the present invention, a toy modular unit is provided for use in a layout representing a city having streets or thoroughfares. The modular unit includes a base member having an upper surface, a lower surface and a plurality of edges. Simulated building structures may be affixed to the base member.

The modular unit may have a groove formed in its lower surface adjacent each edge so that C-shaped connectors may be used to connect a plurality of modular units together by engaging a first groove along an edge of one modular unit and a second groove provided on a second modular unit.

The modular unit also includes a toy vehicle propulsion device which is mounted to the upper surface adjacent a lane of the simulated thoroughfare. The propulsion device includes a swingably mounted arm which is actuable through a pushbutton coacting with a helical cam in a manner such that the arm swings out into the path of travel of a toy vehicle when the pushbutton is depressed to propel the vehicle.

BRIEF DESCRIPTION OF THE DRAWINGS

The details of the present invention will be described in connection with the accompanying drawings, in which like reference numerals refer to like elements in the several views.

BEST MODE FOR CARRYING OUT THE INVENTION

Figure 1:
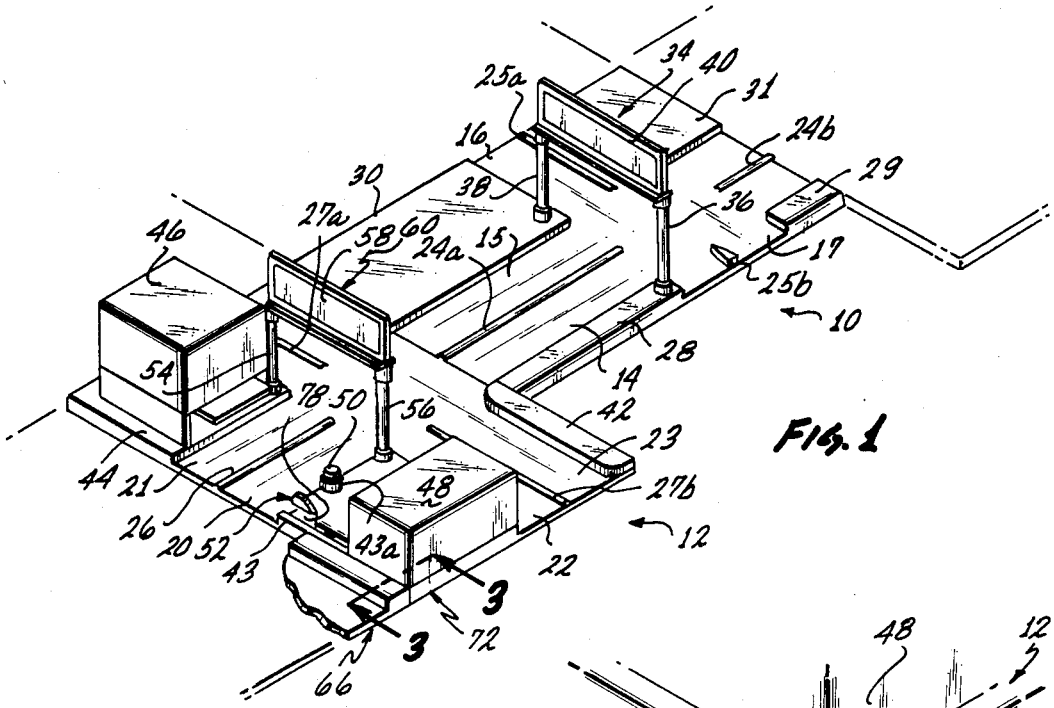
FIG. 1 is a perspective view of a plurality of modular units of the present invention.

Referring to the drawings, and particularly to FIG. 1, there is shown an assembly, including a first modular unit, generally designated 10, connected to a second modular unit, generally designated 12, with the two units, as connected simulating a city thoroughfare, and particularly an intersection.

Each of the modular units 10 and 12 has a generally planar undersurface for positioning or placing on a surface along with other interconnecting modules (not shown), or other track sections (not shown) which interconnected sections ultimately form a closed loop for passage of toy vehicles thereover.

Each of the modular units 10 and 12 is configured for defining roadways divided into lanes, such as lanes 14–17 on unit 10 and lanes 20 through 23 on unit 12. The lanes are divided for toy vehicle travel in opposite directions by suitable lane dividers 24*a* and 24*b*, which divide lanes 14 and 15; dividers 25*a* and 25*b*, which divide lanes 16 and 17; divider 26, which divides lanes 20 and 21; and dividers 27*a* and 27*b*, which divide lanes 22 and 23.

As can be seen in FIG. 1, the dividers 24*a*, 24*b* and 26 are in aligned relation, and along with lanes 14, 15, 20 and 21 simulate a "street" arranged in a first direction. Intersecting "streets" are also provided. A first "street" formed of lanes 16 and 17 is formed in the first unit 10 at right angles to the lanes 14 and 15. A second intersecting "street" is formed in unit 12 by lanes 22 and 23 at right angles to the lanes 20 and 21. Integrally formed within each unit are portions configured for simulating curbs and sidewalks, such as portions 28–31 in unit 10, the upper surfaces of these portions being in a common plane elevated from the common plane of the lanes 14–17. The overall configuration of the first modular unit 12, in plan view, is generally rectangular, and as will hereafter be described, means are provided on the undersurface for interconnection to adjacent modules or track sections.

Further included on the first modular unit 10 is a simulated street sign, generally designated 34, which includes first and second post members 36 and 38 secured to the upper surfaces of portions 28 and 30, respectively, at right angles thereto. Secured to the upper ends of post members 36 and 38, in transverse relation thereto is a rectangular simulated sign member 40, the parts being configured in an inverted U-shaped relation to serve as carrying means, that is as a handle.

The second modular unit 12 has a generally rectangular plan configuration, with the long side thereof shown at right angles to the short side of unit 10. Similarly, unit 12 has elevated portions 42–44 which simulate curbs and sidewalks. Mounted atop portion 44 is a box-like structure 46, which may be configured to depict a building, such as a store or a garage, adjacent the roadway formed of lanes 20 and 21. On the opposite side of the "street" there is another box-like structure 48, which is positioned adjacent to a toy vehicle propulsion device, the actuating plunger 50 of which extends upwardly from the surface of portion 43 in proximity to lane 20. The driving member 52 of the toy vehicle propulsion device has an upwardly extending end portion shown adjacent the plunger 50. The details of the propulsion device will be described later. Connected to the upper surfaces of portions 44 and 43 are upwardly extending post members 54 and 56, the upper ends of which suitably support a transversely extending simulated sign member 58 to form a simulated street sign, generally designated 60, which is virtually identical to the street sign 34, and, likewise serves as a carrying means for the second modular unit 12.

For assembly purposes, the units 10 and 12 may be interconnected in different relative orientations, one of which is shown in FIG. 1, that is with the "rectangles" at right angles to each other. As can be seen, however, if unit 12 were to be rotated 90° in a clockwise direction, the lanes 22 and 23 would align with lanes 15 and 14, respectively, of the first modular unit 10, since the lanes of both units are offset to the one side of the rectangular bases of the units 10 and 12. This is accomplished by suitable detents or grooves 62 and 64 (See also FIGS. 2 and 3) formed in the undersurfaces of adjacent units 66 and 12, respectively, in close proximity to the edges 68 and 13, respectively, thereof, which edges are generally planar and configured for abutting relation when a C-shaped connector 70 is inserted into adjacent grooves 62 and 64 (see FIG. 3). The connector 70 is configured with a planar bight portion, which, in the engaged position fits flush with the adjacent undersurfaces of the units 68 and 12. In proximity to the grooves 62 and 64, the undersurfaces are recessed to provide the clearance required for this fit.

Figure 2:
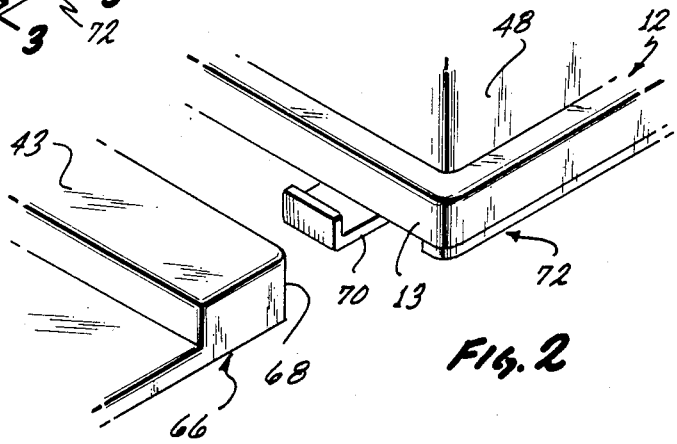
FIG. 2 is a partial, exploded perspective view of a connector and two modular units.
Figure 3:
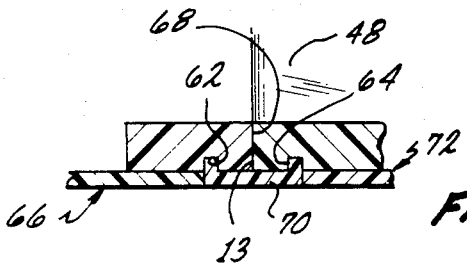
FIG. 3 is an enlarged cross-sectional view taken along line 3—3 of FIG. 1.

By referring to FIG. 2, the connector 70 is shown extending from the undersurface of unit 12 adjacent the corner of edge 13 thereof. Although not shown, beneath the adjacent edge 72 of unit 12, there is another groove, disposed at right angles to the groove 64 for the purpose of permitting interconnection to an adjacent modular unit for extending the lanes 22 and 23. For interconnecting to narrower sections of track only, by reference to FIG. 1, the undersurface of unit 12, just to the left of lane 22 (as viewed in FIG. 1) would be provided with a groove in proximity to, and in parallel relation with the edge 72 thereof. Optimally, each module would have a plurality of grooves on the undersurface thereof, so aligned to provide a myriad of interconnections to the various modular units available in such play systems.

Figure 4:
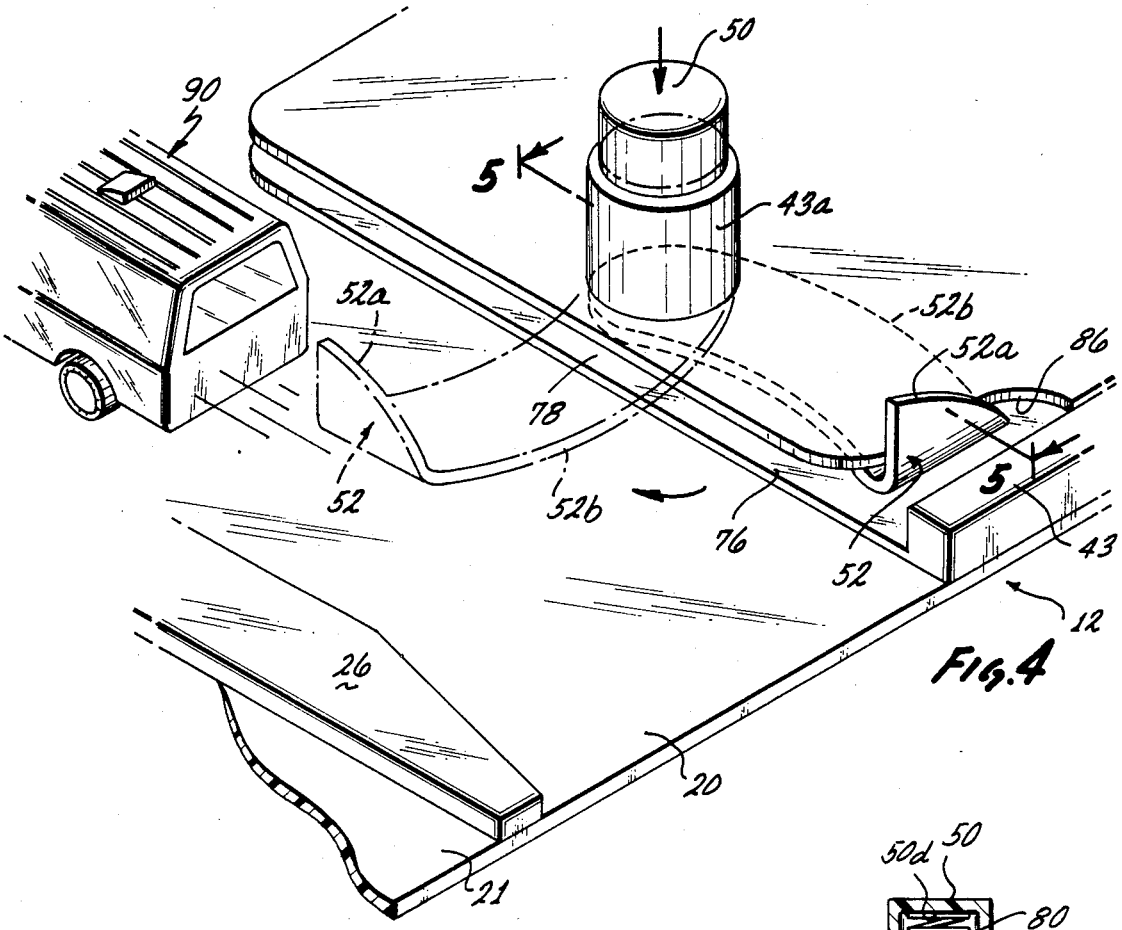
FIG. 4 is an enlarged perspective view of the vehicle propulsion device portion of FIG. 1.
Figure 5:
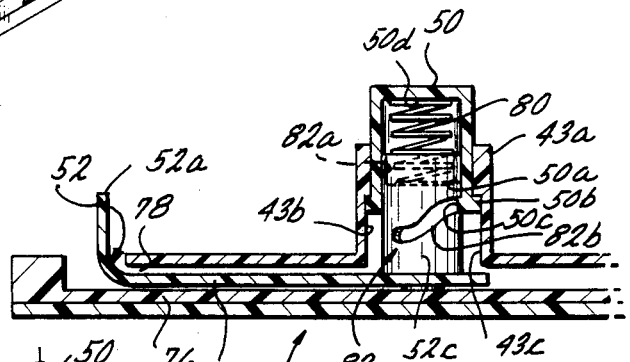
FIG. 5 is a cross-sectional view taken along line 5—5 of FIG. 4 as showing the propulsion device in a retracted, at-rest position.
Figure 6:
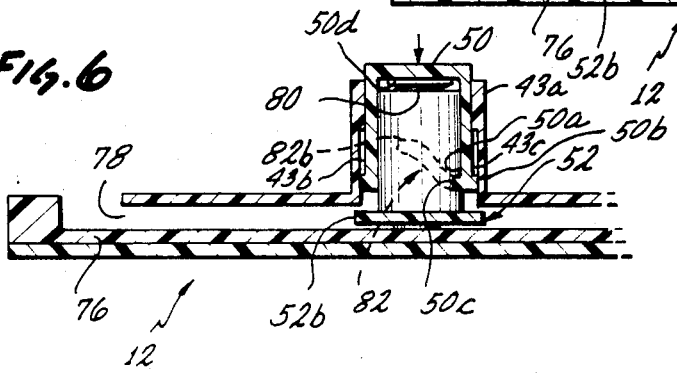
FIG. 6 is a view similar to FIG. 5 showing the propulsion device in an operating position.

Referring now to FIGS. 4 through 6, the details pertaining to the vehicle propulsion device will now be described. In FIG. 4, there is shown a portion of the modular unit 12 oriented at 90° counterclockwise to the position shown in FIG. 1 to more fully illustrate the propulsion device. The upper surface portion 43 of unit 12 is a generally plate shaped member spaced from and generally parallel to a lower plate shaped member 76, which lies in a plane slightly above the plane of the adjacent lane 20. The space 78 between the two plate shaped members is of a height sufficient for passage therethrough of the driving member 52 which is configured as a generally bar-shaped member with the free end thereof having an upwardly extending portion 52*a*. In short, the height of the space 78 is slightly greater than the thickness of the bar arm 52*b* of the driving member 52.

By referring specifically to FIG. 5, it can be seen that the vehicle propulsion device is simple and uncomplicated, the basic structural parts including the plunger 50, a coil spring 80, a plunger sleeve 43*a* formed integrally with the upper surface of portion 43, and the driving member 52. The driving member 52 is generally bar shaped having a central bar arm portion 52*b* of generally planar configuration in plan view, and arcuately configured, with an upwardly extending first end portion 52*a*. The other end of driving member 52 has secured thereto a helical cam member, generally 82 of an inverted cup-shaped configuration with a recess 82*a* in the upper surface thereof for receiving one end of the coil spring 80. The cam member is otherwise tubular with a helical slot 82*b* formed in the wall thereof, with the lower skirt portion of the cam member 82 being secured to the inner end of the driving member 52, with the cam member 82 at right angles to the driving member 52 to serve as the pivot point therefor.

The plunger 50 is of an inverted cup-shaped tubular configuration with an open bottom 50*a* having a diameter slightly larger than the outer diameter of cam member 82 for fitting thereover in telescopic relation. The outer periphery of the bottom of plunger 50 is provided with two aligned opposing tab portions 50*b*, and an inwardly extending cam slot engaging pin 50*c*. The coil spring 80 is positioned between the recess 82*a* and the undersurface 50*d* of the top of the plunger 50.

The plunger sleeve 43*a* is secured to, or formed integrally with the portion 43 at generally right angles thereto, the sleeve 43*a* being open at both ends. The inner diameter of the upper end of sleeve 43*a* is slightly greater than the outer diameter of the main portion of the plunger 50 for slidably receiving the plunger 50 therein. At approximately halfway down, the inside of the sleeve 43*a* is provided with a pair of axially extending diametrically opposed slots 43*b* and 43*c* having a width sufficient for slidably receiving therein the opposing tab portions 50*b* of the plunger 50.

In the assembled condition of the vehicle propulsion device, the plunger 50 is inserted in the sleeve 43*a* with the tab portions 50*b* in engagement within the slots 43*b* and 43*c*, thus restricting the plunger movement ro and axial non-rotating direction. The spring 80 is placed in the recess 82*a* of the cam member 82, and the cam member 82 is elevated until the cam pin 50*c* of the cam member 50 engages within the helical cam slot 82*b*. The plate portion 43 is then assembled to its overlying relation with member 76 to complete the assembly. The lower surface of cam member 82 may either rest directly on the lower plate shaped member 76, or may be provided with a centrally located downwardly depending stub pivot projection as illustrated.

As assembled, by reference to FIG. 5, the force of the coil spring 80 urges against plunger 50, providing an upward force which is resisted by the tab portions 50*b* of the plunger 50 abutting against the shoulders formed at the upper ends of slots 43*b* and 43*c*. The position of the parts shown in FIG. 5 and in solid lines in FIG. 4 is the normal, unactuated, at-rest position, with the driving member 52 retracted away from the lane 20 of the roadway, with the upwardly extending end portion 52*a* thereof resting within the slot 86 formed in the surface portion 43 to accommodate this end. To actuate the propulsion device, a toy vehicle 90 is placed on lane 20 in proximity to the slotted space 78 through which the driving member 52 is actuated from the solid line position to the dotted line position illustrated in FIG. 4 upon depression of the plunger 50. The end portion 52*a* then makes physical contact with the non-motorized toy vehicle 90 to commence movement of the vehicle along the lane 20.

The helical cam 82 has the cam slot 82*b* thereof cut through the sidewall thereof through an angle of approximately 90°, with the contour of slot 82*b* being gnerally S-shaped and of a height sufficient to pivot the driving member through an angle of 90° with an axial displacement of plunger 50 through the distance generally equal to the axial height of the slot 82*b*. Upon depression of the plunger 50 (as indicated by the arrow thereabove in FIGS. 4 and 6), the pin 50*c* of plunger 50 moves axially downward, thereby forcing the cam member 82 to rotate clockwise, as depicted in FIG. 4, until the driving member 52 is pivoted through an angle of approximately 90°, whereupon the end portion 52*a* of driving member 52 contacts the rear of the toy vehicle 90. Upon release of the plunger 50, the force of spring 80 urges the plunger 50 upwardly from the lowermost position illustrated in FIG. 6 until the plunger 50 returns to its normal position in FIG. 5. During this reverse travel, the cam pin 50*c* in engagement within the slot 82*b* reverses the direction of travel of the driving member 52 to pivot it from the dotted line position shown in FIG. 4 to the solid line position. Thus the propulsion device is not only uncomplicated, but is self-resetting.

Although the description of operation has referred to a stationary toy vehicle 90, the propulsion device can be used as a "booster" for moving vehicles traveling lane 20. If the user is sufficiently manually adept, the plunger 50 can be depressed upon the moving vehicle entering the section of lane 20 adjacent the slotted space 78 through which the driving member 52 passes. In this manner, with enough practice, the user can give the vehicle 90 a "boost" as it passes the vehicle propulsion device.

Although not shown, it is to be understood that the modular units 10 and 12 heretofore described are parts of a larger arrangement of a play setting including other modules such as track sections which may be interconnected with the units 10 and 12 to form a closed loop roadway for travel thereover of a number of toy vehicles to simulate a city setting. Of course, the track sections would have connection means as heretofore described for providing the connections. While there has been shown and described a preferred embodiment, it is to be understood that various other adaptations and modifications may be made within the spirit and scope of the invention.

What is claimed is:

1. In a modular unit for a toy vehicle traversing layout, the combination comprising:

a generally planar surface adapted to form a lane for passage thereover of a toy vehicle;

a toy vehicle propulsion device affixed to said modular unit adjacent to said lane, said propulsion device including:

a sleeve member formed in said unit adjacent said lane;

a driving member having cam means with a cam portion and being mounted for pivotable movement about an axis generally perpendicular to the plane of said lane;

means normally biasing said driving member to a first position away from said lane; and actuating means including a plunger member with a cam pin, said plunger member being slidably mounted in said sleeve member and being manually depressible along said axis, said plunger member cam pin coacting with the cam portion of said cam means of said driving member and the biasing means for pivoting said driving member to a second position, said driving member being configured for urging against the body of a toy vehicle for propelling the same in response to movement of said driving member from said first to said second position.

2. The combination as recited in claim 1 wherein said biasing means returns the actuating means to the non-depressed position upon release thereof.

3. The combination as recited in claim 1 wherein said sleeve member has slot means on the inner surface thereof and said plunger member has matingly engaging tab portions extending into said slot means for restricting the movement of said plunger to an axial direction.

4. The combination as recited in claim 2 wherein said cam means is of an inverted generally cup-shaped configuration telescopically mounted within said plunger member, and said cam portion is a helical slot in said cam means coating with a cam pin affixed to said plunger member.

5. The combination as recited in claim 3 wherein said biasing means is a coil spring interposed between said plunger member and said cam means.

6. The combination as recited in claim 1 wherein said driving member is a generally bar-shaped member having an upwardly extending end portion configured for physical contact with a vehicle adjacent said propulsion device upon actuation thereof.

7. In a modular unit for a toy vehicle traversing layout, the combination comprising:

a generally planar surface adapted to form a lane for passage thereover of a toy vehicle;

a toy vehicle propulsion device affixed to said modular unit adjacent to said lane, said propulsion device including:

a sleeve member formed in said unit adjacent said lane;

a driving member having a cam means extending into said sleeve member, said cam means having an inverted generally cup-shaped portion with a helical slot therein and being mounted for pivotable movement about an axis generally perpendicular to the plane of said lane;

means coacting with said cam means for normally biasing said driving member to a first position away from said lane; and actuating means including a plunger member slidably mounted within said sleeve member and being telescopically coupled to said cup-shaped portion, said plunger member having a cam pin engaging said helical slot and being manually depressible along said axis, said plunger member cam pin coacting with the helical slot of said cam means of said driving member and the biasing means for pivoting said driving member to a second position, said driving member being configured for urging against the body of a toy vehicle for propelling the same in response to movement of said driving member from said first to said second position.

* * * * *